US011448446B2

(12) United States Patent
Zhang et al.

(10) Patent No.: US 11,448,446 B2
(45) **Date of Patent: *Sep. 20, 2022**

(54) ICE CRUSHING DEVICE AND REFRIGERATOR

(71) Applicant: QINGDAO HAIER CO., LTD., Qingdao (CN)

(72) Inventors: Kui Zhang, Qingdao (CN); Xiaobing Zhu, Qingdao (CN); Yanqing Zhang, Qingdao (CN); Chuan Cui, Qingdao (CN); Jianjun Xue, Qingdao (CN); Bo Mi, Qingdao (CN)

(73) Assignee: QINGDAO HAIER CO., LTD., Qingdao (CN)

( * ) Notice: Subject to any disclaimer, the term of this patent is extended or adjusted under 35 U.S.C. 154(b) by 96 days.

This patent is subject to a terminal disclaimer.

(21) Appl. No.: 16/982,585

(22) PCT Filed: Dec. 26, 2018

(86) PCT No.: PCT/CN2018/123729

§ 371 (c)(1),
(2) Date: Sep. 20, 2020

(87) PCT Pub. No.: WO2019/223305

PCT Pub. Date: Nov. 28, 2019

(65) Prior Publication Data

US 2021/0018243 A1 Jan. 21, 2021

(30) Foreign Application Priority Data

May 21, 2018 (CN) ..... 201810489417.7

(51) Int. Cl.
*F25C 5/04* (2006.01)

(52) U.S. Cl.
CPC ..... *F25C 5/046* (2013.01)

(58) Field of Classification Search
CPC ..... F25C 5/046; F25C 2400/10
(Continued)

(56) References Cited

U.S. PATENT DOCUMENTS 1,116,096 A * 11/1914 Miller ..... B01F 29/64 384/129
1,346,405 A * 7/1920 Hendrickson ..... B23D 51/14 83/566

(Continued)

FOREIGN PATENT DOCUMENTS

CN 2080646 U 7/1991
CN 2204038 Y 7/1995

(Continued)

*Primary Examiner* — Eric S Ruppert
*Assistant Examiner* — Kirstin U Oswald
(74) *Attorney, Agent, or Firm* — Cheng-Ju Chiang

(57) ABSTRACT

An ice crushing device and a refrigerator are provided, the ice crushing device includes a housing assembly including a housing and an ice bucket supported in the housing; a driver for driving the ice bucket to rotate; an ice crusher disposed in the ice bucket; wherein the ice crusher includes an ice cutter shaft fixed with respect to the housing, and several movable ice cutters and several fixed ice cutters disposed on the ice cutter shaft at an interval, each movable ice cutter includes three blades evenly distributed in the circumferential direction, the ice crusher further includes three ice agitating rods connected to the ice cutter shaft, the three ice-agitating rods are fixed corresponding one to one with the three blades, and at least one of the blades or one of the ice agitating rods is fixed relative to circumferential direction of the ice bucket.

9 Claims, 15 Drawing Sheets

(58) Field of Classification Search
USPC ..... 62/66, 320
See application file for complete search history.

(56) References Cited

U.S. PATENT DOCUMENTS 1,776,227 A * 9/1930 Wieland ..... B21D 51/46 413/9
1,787,837 A * 1/1931 Powers ..... A23G 9/12 366/144
1,998,841 A * 4/1935 Modlin ..... A23G 9/12 366/206
2,077,430 A * 4/1937 Morin ..... G07F 11/58 194/247
2,139,576 A * 12/1938 Davis, Jr. ..... A23G 9/12 366/279
2,200,273 A * 5/1940 Hudson ..... A23G 9/12 366/222
2,555,624 A * 6/1951 Anderson ..... A23G 9/12 366/144
2,844,038 A * 7/1958 Danta ..... G05G 5/04 74/425
3,009,402 A * 11/1961 Crumrine ..... G03G 15/266 222/DIG. 1
3,423,949 A * 1/1969 Esser ..... F25C 1/12 62/352
3,587,478 A * 6/1971 Tomik ..... A23G 9/283 425/118
3,590,653 A * 7/1971 Dreckmann ..... F23N 5/006 60/39.27
3,837,587 A * 9/1974 Walter ..... A47J 43/046 241/101.8
3,940,116 A * 2/1976 Verlinden ..... F25C 5/00 366/279
4,020,715 A * 5/1977 Sollars ..... F16H 57/031 74/606 R
4,111,264 A * 9/1978 van der Lely ..... A01B 33/085 172/49.5
4,176,527 A 12/1979 Linstromberg et al.
4,402,194 A * 9/1983 Kuwako ..... F25C 1/04 62/353
4,450,692 A * 5/1984 Sharpe ..... A23G 9/12 62/342
4,696,199 A * 9/1987 Fabbri ..... F16H 1/14 74/606 R
4,972,999 A * 11/1990 Grace ..... F25C 5/046 62/320
5,090,827 A * 2/1992 Hirano ..... B41J 23/025 400/229
5,743,670 A * 4/1998 Ader ..... E04B 1/6137 403/403
6,336,603 B1 * 1/2002 Karkos, Jr ..... H02K 7/11 241/101.8
6,617,726 B1 * 9/2003 Tsergas ..... H02K 11/38 310/83
7,111,473 B2 * 9/2006 Chung ..... F25C 5/046 62/320
7,418,823 B2 * 9/2008 Sato ..... F25D 17/042 62/340
7,975,347 B1 * 7/2011 Moses ..... A47L 1/05 15/93.1
8,505,404 B2 * 8/2013 Takada ..... F16D 41/206 74/404
8,714,414 B2 * 5/2014 Koons ..... F25C 5/20 62/320
10,036,586 B2 * 7/2018 Yang ..... F25C 5/22
11,067,326 B2 * 7/2021 Miller ..... F25C 5/22
2004/0070297 A1 4/2004 Yoon et al.
2004/0099076 A1 * 5/2004 Haskin ..... F16H 37/041 74/425
2004/0261442 A1 * 12/2004 Chung ..... F25C 5/24 62/344
2006/0059939 A1 * 3/2006 An ..... F25C 5/046 62/320
2007/0173368 A1 * 7/2007 Takada ..... F16H 48/34 475/230
2007/0227176 A1 10/2007 Anell et al.
2007/0267154 A1 * 11/2007 Gramsch ..... E06B 9/361 160/173 R
2008/0156826 A1 * 7/2008 Kim ..... F25C 5/22 221/253
2010/0072300 A1 * 3/2010 Miller ..... B05B 9/0861 239/332
2010/0181136 A1 * 7/2010 Swasey ..... E04H 6/245 29/428
2011/0012446 A1 * 1/2011 Maute ..... H02K 7/145 310/50
2011/0048052 A1 3/2011 Lee et al.
2011/0232318 A1 * 9/2011 Ramirez, Jr ..... H02K 23/64 62/320
2011/0239798 A1 * 10/2011 Ramirez, Jr. ..... H02K 5/10 74/412 R
2013/0104587 A1 * 5/2013 Nuss ..... F25C 5/046 62/320
2013/0105611 A1 * 5/2013 Nuss ..... F25C 5/046 241/277
2013/0333503 A1 * 12/2013 Peura ..... F16H 1/14 74/405
2014/0157917 A1 * 6/2014 Oestreich ..... B60S 9/08 74/89.13
2014/0338475 A1 * 11/2014 Lobo ..... F16K 31/00 74/30
2015/0075311 A1 * 3/2015 Kanzaki ..... F16H 57/02 74/421 A
2015/0316307 A1 11/2015 Lee et al.
2015/0345851 A1 * 12/2015 Ramirez, Jr. ..... H02K 7/116 310/71
2016/0216021 A1 7/2016 Kang et al.
2016/0221410 A1 * 8/2016 Mersmann ..... F16H 25/20
2016/0341463 A1 * 11/2016 Guo ..... F25C 5/046
2017/0276418 A1 * 9/2017 Celik ..... F25C 5/185
2017/0363340 A1 * 12/2017 Li ..... F25C 5/046
2017/0373558 A1 * 12/2017 Ramirez, Jr ..... H02K 5/22
2018/0008087 A1 * 1/2018 Miller ..... A47J 31/407
2019/0063810 A1 * 2/2019 Saito ..... F25C 1/22
2019/0068031 A1 * 2/2019 Saito ..... H02K 11/33

FOREIGN PATENT DOCUMENTS

CN 1576760 A 2/2005
CN 201045550 Y 4/2008
CN 101821567 A 9/2010
CN 102102930 A 6/2011
CN 202792753 U 3/2013
CN 203857727 U 10/2014
CN 104329844 A 2/2015
CN 105423672 A 3/2016
CN 105444484 A 3/2016
CN 205336029 U 6/2016
CN 105987553 A 10/2016
CN 206037532 U 3/2017
CN 107014127 A 8/2017
CN 107940850 A 4/2018
CN 108036560 A 5/2018
CN 108050742 A 5/2018
CN 108662821 A 10/2018
CN 108759216 A 11/2018
CN 108759217 A 11/2018
CN 108759218 A 11/2018
CN 108800694 A 11/2018
JP 2010-286186 A 12/2010
WO WO-2013169058 A1 * 11/2013 ..... F25C 1/04

* cited by examiner

ICE CRUSHING DEVICE AND REFRIGERATOR

The present application is a 35 U.S.C. § 371 National Phase conversion of International (PCT) Patent Application No. PCT/CN2018/123729, filed on Dec. 26, 2018, which claims priority to Chinese Patent Application No. 201810489417.7, filed on May 21, 2018 and titled "Ice Crushing Device and Refrigerator", the content of which is incorporated herein by reference in its entirety. The PCT International Patent Application was filed and published in Chinese.

TECHNICAL FIELD

The present invention relates to the field of household appliances and particularly to an ice crushing device and a refrigerator.

BACKGROUND

As science and technology develops continuously and people's living standard improves continuously, in order to adapt for people's higher and higher requirements for life quality, household appliances also have more and more functions, e.g., an ice maker is added to the refrigerator. The ice maker of the refrigerator comprises an ice making device and an ice crushing device. The ice making device prepares ice cubes and then stores them in a barrel-shaped container for access by the user. Meanwhile, to facilitate use, technicians set ice-providing modes of the refrigerator as an ice-crushing mode and an ice cube mode. In the ice-crushing mode, what the user gets are crushed ice cubes, whereas in the ice cube mode, what the user gets is a whole ice cube.

In the prior art, the ice-crushing mode and the ice cube mode are implemented by setting an ice crushing blade assembly in the barrel-shaped container. The ice crushing blade assembly comprises a fixed ice cutter and a movable ice cutter. A rotating shaft of the ice crushing blade assembly is movably inserted through one end of the fixed ice cutter and fixedly inserted through one end of the movable ice cutter so that the rotating shaft brings the ice cutter to rotate. When the rotating shaft rotates positively (i.e., rotates towards the fixed ice cutter) and the movable ice cutter crosses with the fixed ice cutter, the ice crushing blade assembly crushes the ice cube. This is the ice crushing mode. When the rotating shaft rotates reversely, the ice crushing blade assembly only functions to drive and stir the ice cube nearby the ice cutter and causes the ice cube to slide out of an outlet of the shaped-shaped container. This is the ice cube mode.

However, when the user opens or closes the refrigerator door, the ice cube is prone to drop out of the outlet due to the shake.

In addition, the driving mechanisms of the ice crushing devices mostly employ gears. However, gears are made of iron, many iron chips might fall off during long-term use. As the mechanism rotates, these iron chips enter the ice cutter region and blend with the ice cubes.

There is another problem. The crushed ice will finally pile at the bottom of the ice bucket, which affects the transmission of the motive power.

Ice generally enters the ice crushing device from above. If the ice crushing device is not used in a long period of time, a lot of ice cubes at the top will be frozen together. In this case, an ice agitating rod is needed to separate the frozen-together ice cubes. If the ice agitation amount one time is large or the ice crushing amount one time is large, the ice crushing mechanism might get stuck and the ice crushing rate is small.

In view of the above problems, the prior art needs to be further improved.

SUMMARY

An object of the present invention is to provide an ice crushing device and a refrigerator, so that the use of the ice crushing device and the refrigerator is made more efficiently.

To achieve one of the above objects of the invention, the present invention provides an ice crushing device, comprising:

a housing assembly comprises a housing and an ice bucket supported in the housing;

a driver for driving the ice bucket to rotate;

an ice crusher disposed in the ice bucket;

the housing assembly further comprises an ice-discharging plate provided at a bottom of the ice bucket, the ice-discharging plate is provided with an ice-discharging port communicated with the ice bucket, ice cubes prepared by an ice maker are discharged out of the ice-discharging port after being crushed in the ice bucket by the ice crusher, wherein the ice crusher comprises an ice cutter shaft fixed with respect to the housing, and several movable ice cutters and several fixed ice cutters disposed on the ice cutter shaft at an interval, each movable ice cutter comprises three blades evenly distributed in the circumferential direction, the ice crusher further comprises three ice agitating rods connected to the ice cutter shaft, the three ice agitating rods are connected to at one end of the ice cutter shaft away from the ice-discharging port, the three ice-agitating rods are fixed corresponding one to one with the three blades and relative to the circumferential direction, and at least one of the blades or one of the ice agitating rods is fixed relative to circumferential direction of the ice bucket.

As a further improvement of the embodiment of the present invention, the inner wall of the ice bucket is provided with at least one first limiting groove extending in the axial direction, one end of one of the three ice agitating rods is snap fitted in the first limiting groove, and one of the three blades is circumferentially fixed to the ice agitating rod.

As a further improvement of the embodiment of the present invention, two movable ice cutters and two fixed ice cutters are provided, the movable ice cutters and the fixed ice cutters are disposed adjacent to each other, one end of each ice agitating rod is provided with a second limiting groove extending in the axial direction, the corresponding blades of the two movable ice cutters are respectively provided with a projection, and the corresponding two projections of the corresponding two blades of the upper and lower movable ice cutters are all snap fitted in the second limiting slot.

As a further improvement of the embodiment of the present invention, the driver comprises a motor and a cylindrical gear driven by the motor, an outer circumference of the ice bucket is provided with external teeth, and the cylindrical gear meshes with the external teeth to drive the ice bucket to rotate.

As a further improvement of the embodiment of the present invention, a gear assembly is provided between the motor and the cylindrical gear, the gear assembly comprises a first bevel gear connected to the motor and a second bevel gear meshing with the first bevel gear, and the cylindrical gear and the second bevel gear are disposed coaxially and relatively fixed.

As a further improvement of the embodiment of the present invention, the housing comprises a first portion that houses the ice bucket and a second portion in which the driver is mounted, the first portion is configured to match the outer circumference of the ice bucket, an opening is provided on the first portion, and a meshing portion of the cylindrical gear and the external teeth is located at the opening.

As a further improvement of the embodiment of the present invention, a groove extending along the circumferential direction of the ice bucket is provided between the ice-discharging plate and the first portion, the groove is communicated with the ice-discharging port, and a lower edge of the ice bucket projects into the groove.

As a further improvement of the embodiment of the present invention, the housing assembly further comprises a bottom plate, a bottom of the second portion is open, the bottom plate covers the bottom of the second portion to seal the cylindrical gear between the second portion and the bottom plate, the bottom of the ice-discharging plate is provided with a protrusion at a position corresponding to the groove, the bottom plate is provided with a recess, and the protrusion is snap fitted in the recess.

As a further improvement of the embodiment of the present invention, the housing assembly further comprises a bottom plate, a bottom of the second portion is open, the bottom plate covers the bottom of the second portion to seal the cylindrical gear between the second portion and the bottom plate, the bottom of the ice-discharging plate is provided with a clamping slot, and a portion of the bottom plate is snap fitted in the clamping slot.

As a further improvement of the embodiment of the present invention, the first portion is provided with a first step portion and a second step portion apart in an axial direction of the ice bucket, a backing ring is provided between the ice bucket and the first portion, the backing ring has a flanging at one end, the flanging abuts against the first step portion, and the other end of the backing ring abuts against the second step portion.

To achieve one of the above objects of the present invention, an embodiment of the present invention provides a refrigerator, the refrigerator comprising a cabinet, a door for opening or closing the cabinet, and the ice crushing device according to any of the above embodiments, the ice crushing device being disposed at the cabinet or the door.

As compared with the prior art, the present invention has the following advantageous effects: according to the solutions of the present invention, since the movable ice cutters each having three blades are provided, the ice crushing amount each time is reduced, the ice crushing is easier, and the mechanism will not be stuck due to too large ice crushing amount at a single time; meanwhile, the ice feeding amount is the same as the movable ice cutter having two blades, and reduction of the ice crushing rate will not be caused. The ice crushing is easier, and the ice crushing rate is improved to a certain degree.

DETAILED DESCRIPTION

Figure 1:
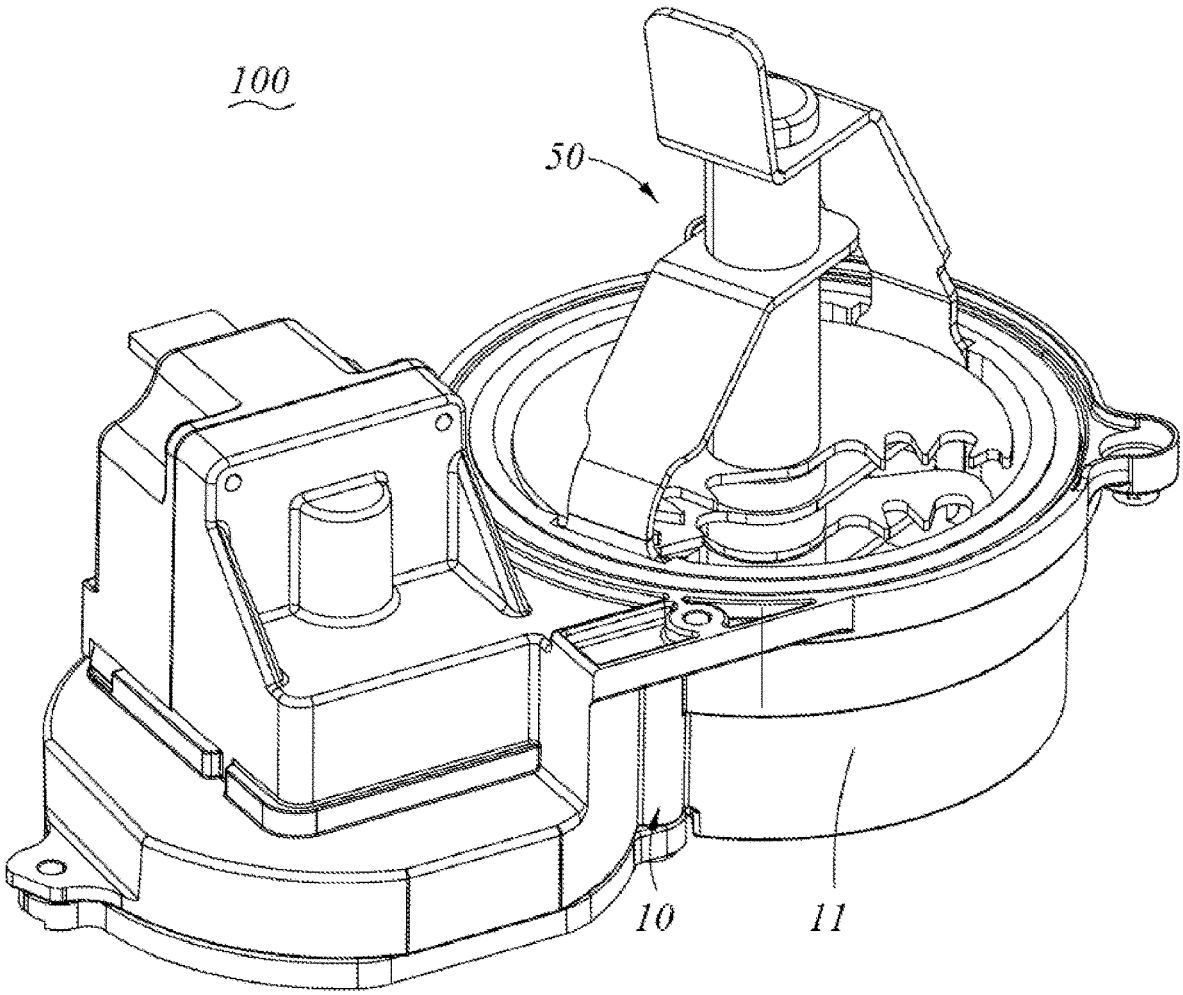
FIG. 1 is a perspective view of an ice crushing device according to a first preferred embodiment of the present invention.
Figure 2:
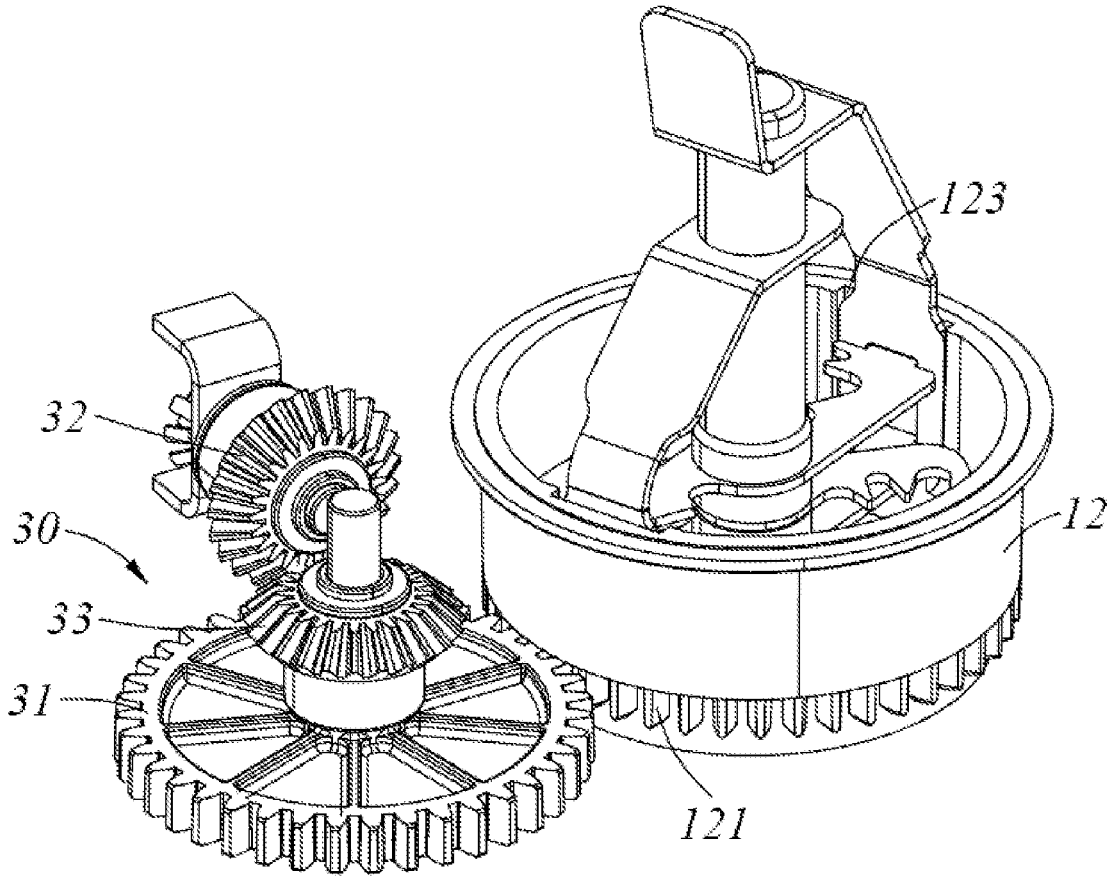
FIG. 2 is a perspective view of the ice crushing device of FIG. 1 with a hosing being removed.

The present invention will be described in detail below with reference to specific embodiments shown in the figures. However, these embodiments are not intended to limit the present invention. Structural, methodological or functional variations made by those skilled in the art based on these embodiments are all comprised in the protection scope of the present invention.

A first preferred embodiment provided by the present invention discloses a refrigerator. The refrigerator comprises a cabinet (not shown) and a door (not shown) for opening or closing the cabinet. The cabinet defines storage compartments. The number and structure of the storage compartments may be configured according to different needs. The storage compartments usually comprise a refrigerating compartment and a freezing compartment.

As shown in FIG. 1 through FIG. 8, the refrigerator further comprises an ice crushing device 100 which is disposed at the cabinet or the door. The ice crushing device 100 comprises a housing assembly 10, a driver 30 mounted on the housing assembly 10, and an ice crusher 50. The housing assembly 10 comprises a housing 11 and an ice bucket 12 supported within the housing 11. The driver 30 is used to drive the ice bucket to rotate, and at least a portion of the driver 30 is installed in the housing. The ice crusher 50 is disposed in the ice bucket 12 and is used to crush the ice cubes prepared by an ice maker. The housing assembly 10 further comprises an ice-discharging plate 13 provided at the bottom of the ice bucket 12, and the ice-discharging plate 13 is fixedly disposed relative to the housing 11. Preferably, the ice-discharge plate 13 and the housing 11 may be disposed integrally, e.g., integrally formed by injection molding. The ice-discharging plate 13 is provided with an ice-discharging port 131 communicated with the ice bucket 12. The ice-discharging port 131 may be a substantially fan-shaped opening on the ice-discharging plate 13. A central angle of the fan-shaped opening is substantially smaller than 180 degrees, preferable between 120 degrees and 170 degrees. The ice cubes prepared by the ice maker are crushed by the ice crusher 50 in the ice bucket 12 and discharged from the ice-discharging port 131.

In order to prevent the ice cubes from falling off from the ice-discharging port 131 due to the shake when the refrigerator door is opened or closed, a slope 1322 may be disposed on the ice-discharging plate 13 adjacent to the ice-discharging port 131 and along the rotary ice discharge direction. The slope 1322 is located on the ice discharge side of the ice-discharging plate 13 and disposed uphill. A main body of the ice-discharging plate 13 is substantially planar. An area of the slope 132 is one-sixth to one-third of the area of the plane of the ice-discharging plate 13, which does not affect the normal ice-crushing of the ice crusher 50. In addition, an inclination angle of the slope 132 with respect to the plane of the ice-discharging plate is between 20 degrees and 50 degrees, and the inclination may be linear, arcuate, or curved. With the slope 132 being disposed, ice cubes must experience an upslope process before falling off, so that crushed ice or ice cubes can be effectively prevented from falling out of the ice-discharging port 131 due to the shake.

In the present embodiment, preferably, the driver 30 comprises a motor (not shown) and a cylindrical gear 31 driven by the motor. An outer circumference of the ice bucket 12 is provided with external teeth 121. The cylindrical gear 31 meshes with the external teeth 121 to drive the ice bucket 12 to rotate. Further, a gear assembly is provided between the motor and the cylindrical gear 31. The gear assembly comprises a first bevel gear 32 connected to the motor and a second bevel gear 33 meshing with the first bevel gear 32. The cylindrical gear 31 and the second bevel gear 33 are disposed coaxially and relatively fixedly, that is, the motor drives the first bevel gear 32 to rotate, and the cylindrical gear 31 and the second bevel gear 33 rotate synchronously, to thereby realize the transmission of a torque from the motor to the ice bucket 12. By providing two bevel gears and the cylindrical gear 31, the overall size of the driver 30 may be reasonably designed, so that the engagement between the motor and the gear assembly is more compact such that the overall volume of the ice crushing device become smaller. Certainly, the driver 30 may also be other transmission structures, such as a belt transmission mechanism, a chain transmission mechanism, a worm wheel-worm mechanism etc. The gear mechanism is not limited to bevel gears, but may also be spur gears, helical gears, herringbone gears, curved gears, and so on.

The housing 11 comprises a first portion 11*a* that houses the ice bucket 12 and a second portion 11*b* in which the driver 30 is mounted. The first portion 11*a* is configured to match the outer circumference of the ice bucket 12, that is, the first portion 11*a* is also provided in a cylindrical shape. The ice bucket 12 rotates in the cylindrical first portion 11*a*. In order to facilitate the power transmission of the ice bucket 12 and the overall sealing performance of the ice crushing device, an opening 111 is provided on the first portion 11*a*, and a meshing portion of the cylindrical gear 31 and the external teeth 121 is located at the opening 111, so that the opening 111 can be minimized as long as the stable meshing of the cylindrical gear 31 and the external teeth 121 can be satisfied. The housing assembly 10 further comprises a bottom plate 14, the bottom of the second portion 11*b* is open, and the bottom plate 14 covers the bottom of the second portion 11*b* to seal the cylindrical gear 31 between the second portion 11*b* and the bottom plate 14. The bottom of the ice-discharging plate 13 is provided with a clamping slot 133. The bottom plate 14 is provided with a bump 143 that is shaped to fit in the clamping slot 133. The bump 143 is fitted in the clamping slot 133. Preferably, both the bump 143 and the clamping slot 133 are both set in a fish shape to enable a better overall sealing perform of the ice crushing device.

The housing 11 comprises a first portion 11*a* that houses the ice bucket 12 and a second portion 11*b* in which the driving mechanism 30 is mounted. The first portion 11*a* is configured to match the outer circumference of the ice bucket 12, that is, the first portion 11*a* is also provided in a cylindrical shape. The ice bucket 12 rotates in the cylindrical first portion 11*a*. In order to facilitate the power transmission of the ice bucket 12 and the overall sealing performance of the ice crushing device, an opening 111 is provided on the first portion 11*a*, and a meshing portion of the cylindrical gear 31 and the external teeth 121 is located at the opening 111, so that the opening 111 can be minimized as long as the stable meshing of the cylindrical gear 31 and the external teeth 121 can be satisfied. The housing assembly 10 further comprises a bottom plate 14, the bottom of the second portion 11*b* is open, and the bottom plate 14 covers the bottom of the second portion 11*b* to seal the cylindrical gear 31 between the second portion 11*b* and the bottom plate 14. The bottom of the ice-discharging plate 13 is provided with a clamping slot 133. The bottom plate 14 is provided with a bump 143 that is shaped to fit in the clamping slot 133. The bump 143 is fitted in the clamping slot 133. Preferably, both the bump 143 and the clamping slot 133 are both set in a fish shape to enable a better overall sealing perform of the ice crushing device.

In addition, the first portion 11*a* is provided with a first step portion 113 and a second step portion 114 apart in an axial direction of the ice bucket 12. A backing ring 16 is provided between the ice bucket 12 and the first portion 11*a* (see FIG. 8). The backing ring 16 has a flanging at one end. The flanging abuts against the first step portion 113, and the other end of the backing ring 16 abuts against the second step portion 114. With the backing ring 16 being disposed, the rotation of the ice bucket 12 is made more stable, and the rotational wear between the ice bucket 12 and the housing 11 is reduced.

Figure 3:
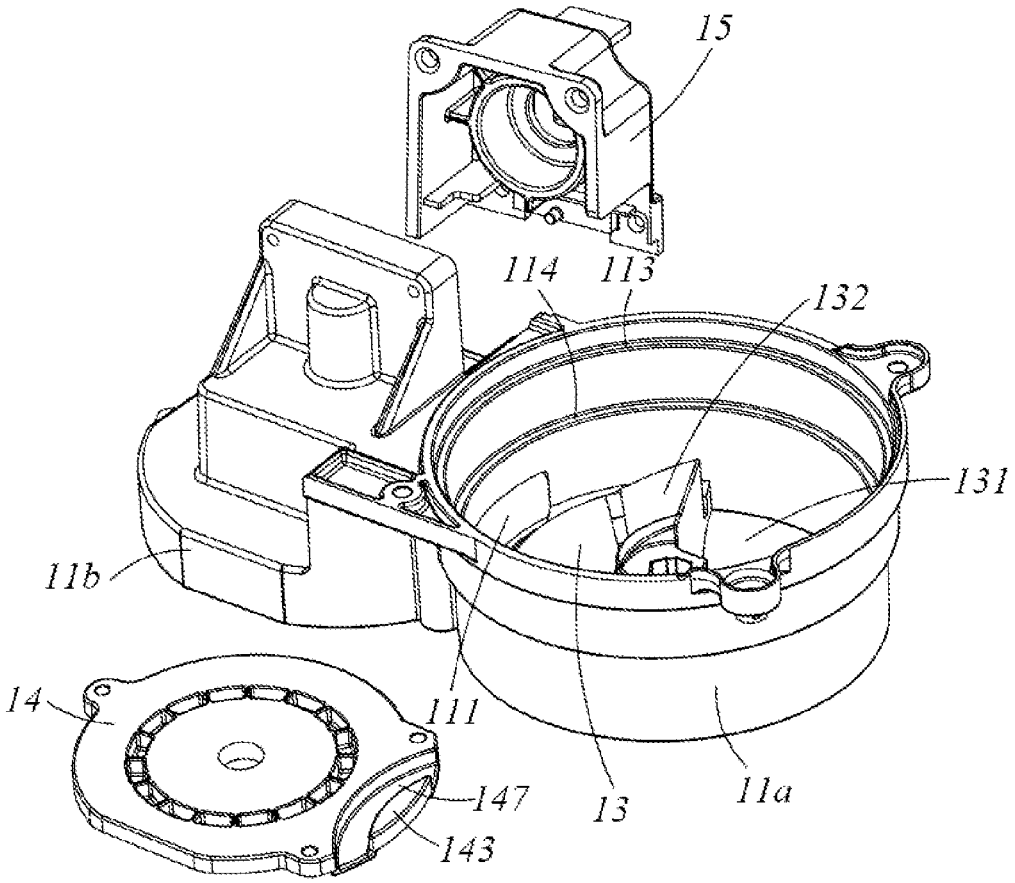
FIG. 3 is an exploded perspective view of a housing assembly in FIG. 1.
Figure 4:
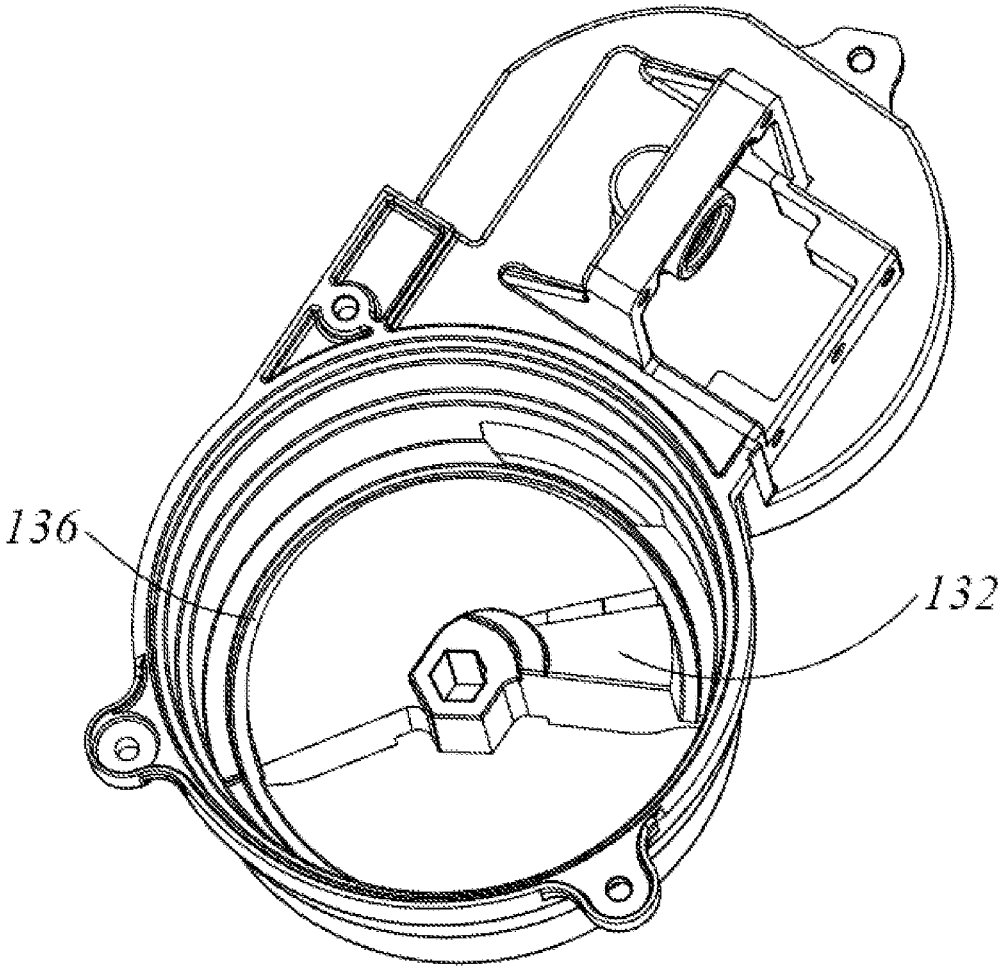
FIG. 4 is a perspective view of the housing in FIG. 1.
Figure 5:
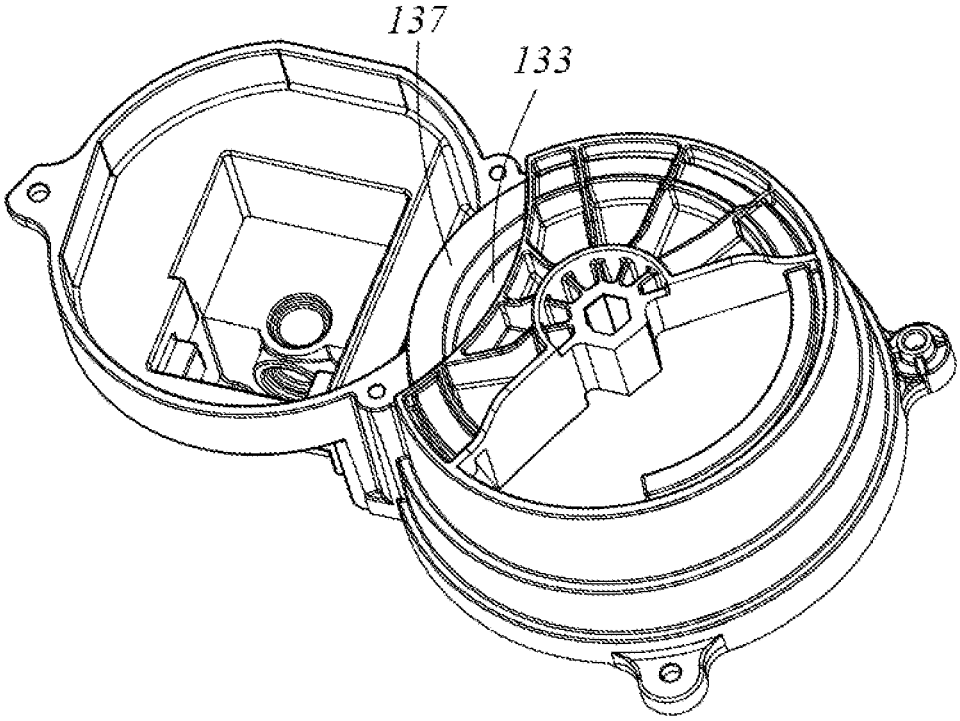
FIG. 5 is a schematic perspective view of the housing of FIG. 1 as viewed from another perspective.

Referring to FIG. 3, for the sake of easy manufacture of the housing 11 and convenient assembling of the driver 30, the housing assembly 10 further comprises a rear cover 15 connected to the housing 11, an outer side of the rear cover 15 is connected to the motor, and the first bevel gear 32 and the second bevel gear 33 are supported between the rear cover 15 and the housing 11. Referring to FIG. 4, since there is relative rotation between the ice bucket 12 and the ice-discharging plate 13 and since there is a gap between the ice bucket 12 and the housing 11 and existence of the opening 111 for the meshing portion between the cylindrical gear 31 and the ice bucket 12, in order to prevent the crushed ice in the ice bucket from entering the driver 30 through the opening 111 or the gap, a groove 136 extending along the circumferential direction of the ice bucket 12 may be provided between the ice-discharging plate 13 and the first portion 11*a*, the groove 136 is communicated with the ice-discharging port 131, and a lower edge of the ice bucket 12 projects into the groove 136. In this way, since the crushed ice cannot cross the groove 136, the crushed ice cannot enter the driver 30 on the other side. The crushed ice will first accumulate in the groove 136. When the ice bucket 12 rotates, the crushed ice will be taken away and fall out of the ice-discharging port 131, thereby effectively solving the problem of the piling of the crushed ice. A protrusion 137 is formed on the bottom of the ice-discharging plate 13 at a position corresponding to the groove 136, the bottom plate 14 is provided with a recess 147, the protrusion 137 is snap fitted into the recess 147 to facilitate mounting the bottom plate, and furthermore, the clamping slot 133 for connecting the bottom plate is adjacent to the protrusion 137, thereby forming a labyrinth seal structure, preventing lubricants or impurities, crushed ice, etc. between the gears from leaking out of the housing assembly 10.

Figure 6:
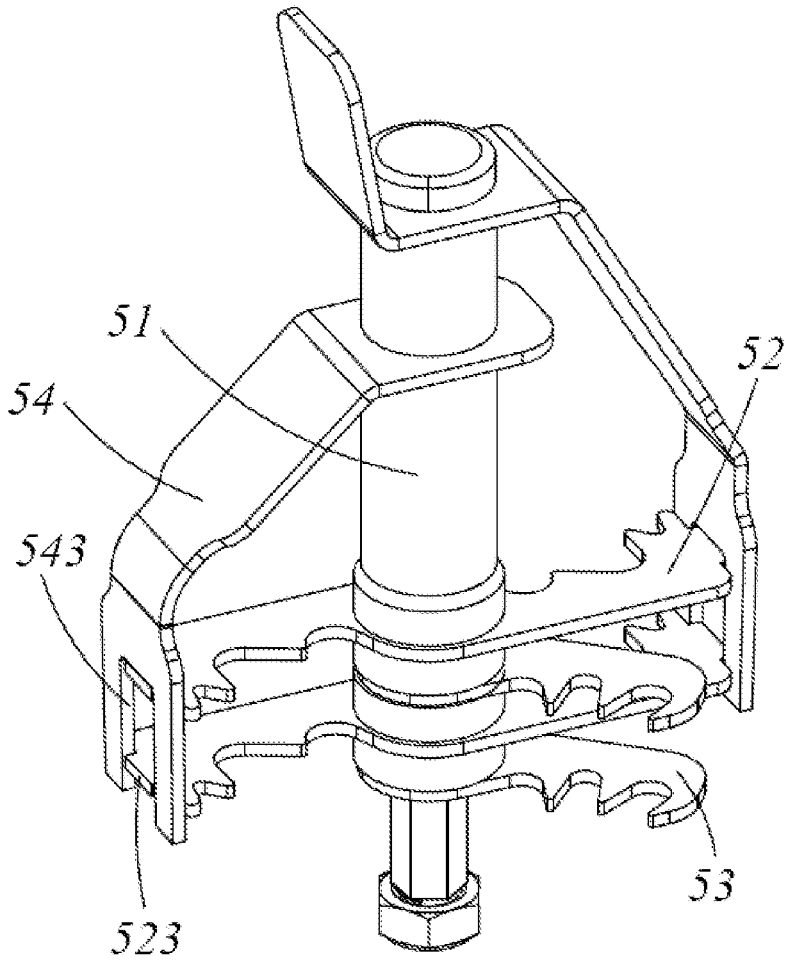
FIG. 6 is a perspective view of an ice crushing assembly of the ice crushing device of FIG. 1.
Figure 7:
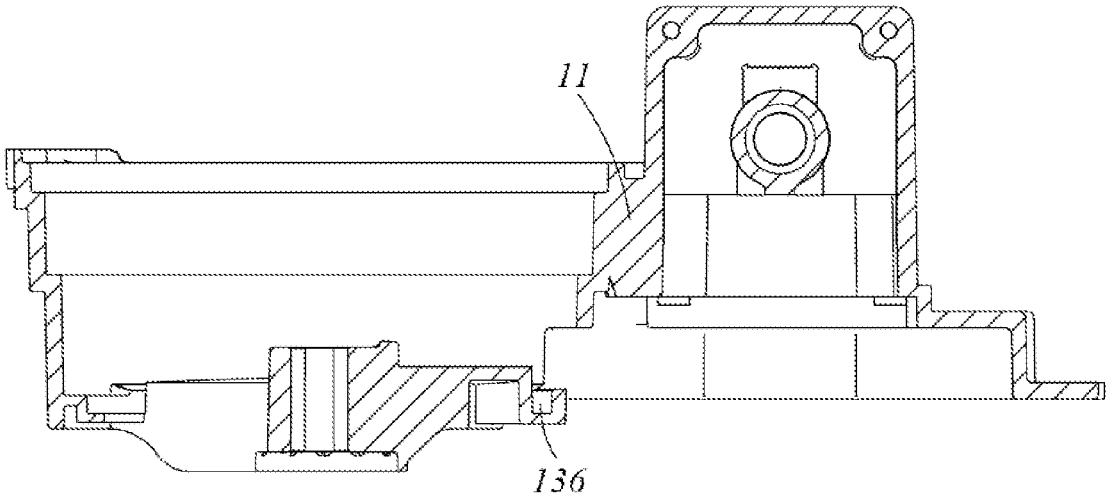
FIG. 7 is a cross-sectional view of the housing of FIG. 5.
Figure 8:
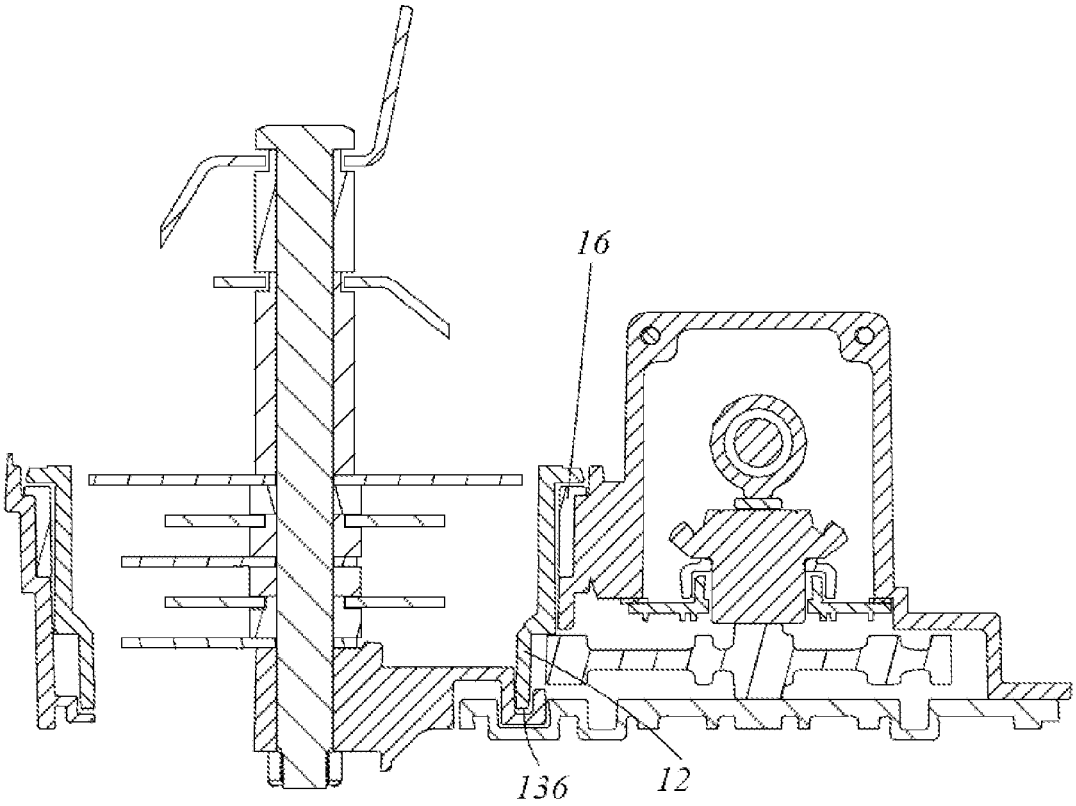
FIG. 8 is a cross-sectional view of the ice crushing device of FIG. 1 with a bottom plate being removed.

Referring to FIG. 6, the ice crusher 50 comprises an ice cutter shaft 51 fixed relative to the housing 11, and several movable ice cutters 52 and several fixed ice cutters 53 disposed on the ice cutter shaft 51 at an interval, wherein the ice cutter shaft 51 is fixed on the ice-discharging plate 13. Different from the prior art, the movable ice cutter 52 is fixed relative to the ice bucket 12, and the fixed ice cutter 53 is fixed relative to the ice cutter shaft 51. As such, the movable ice cutter 52 is driven to rotate by the ice bucket 12, and the fixed ice cutter 53 is fixed relative to the housing 11. The ice cubes in the ice bucket 12 are crushed by the rotation of the movable ice cutter 52 with respect to the fixed ice cutter 53. In addition, in order to prevent the ice cubes from being frozen together, an ice agitating rod 54 may be installed at one end of the ice cutter shaft 51 away from the ice-discharging port 131. The ice agitating rod 54 may extend toward the other end of the ice cutter shaft 51 and be fixed to the movable ice cutter 52, and achieves agitation of the ice cubes as the movable ice cutter 52 rotates. Certainly, the rotation of the movable ice cutter 52 may be enabled in a way that the movable ice cutter 52 is directly fixed on an inner wall of the ice bucket 12, or in a way that the movable ice cutter 52 and the ice agitating rod 54 are fixed relative to each and the ice agitating rod 54 is fixed on the inner wall of the ice bucket 12. The "fixed" here means fixed relative to the circumferential direction of the ice bucket 12, the axial direction may be set to be fixed, or the axial distance may be adjusted relative to the ice bucket 12.

In the present embodiment, preferably, the inner wall of the ice bucket 12 is provided with a first limiting groove 123 extending in the axial direction. One end of the ice agitating rod 54 is snap fitted in the first limiting groove 123, and the movable ice cutter 54 is circumferentially fixed to the ice agitating rod 54. The movable ice cutter 52 comprises two blades in a straight shape, and two movable ice cutters 52 are provided. The two fixed ice cutters 53 are also provided. The movable ice cutters 52 are disposed adjacent to the fixed ice cutters 53. Two ice agitating rods 54 are also disposed, corresponding to the number of blades of the movable ice cutter. One end of the ice agitating rod 54 is provided with a second limiting groove 543 extending in the axial direction. The two blades of each of the two movable ice cutters 52 are respectively provided with a projection 523. The two projections 523 are both snap fitted in the second limiting groove 543 to achieve the circumferential fixation of the movable ice cutter 52 relative to the ice agitating rod 54.

Figure 9:
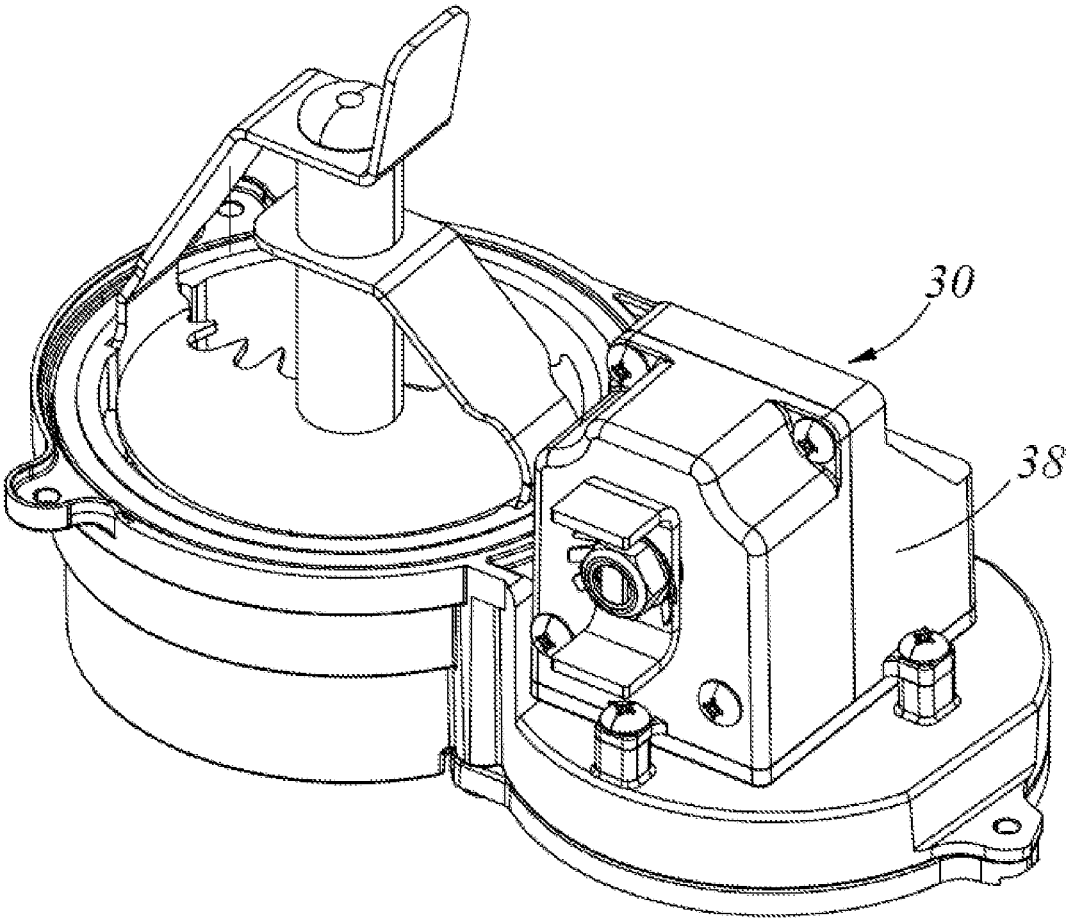
FIG. 9 is a perspective view of an ice crushing device according to a second preferred embodiment of the present invention.
Figure 10:
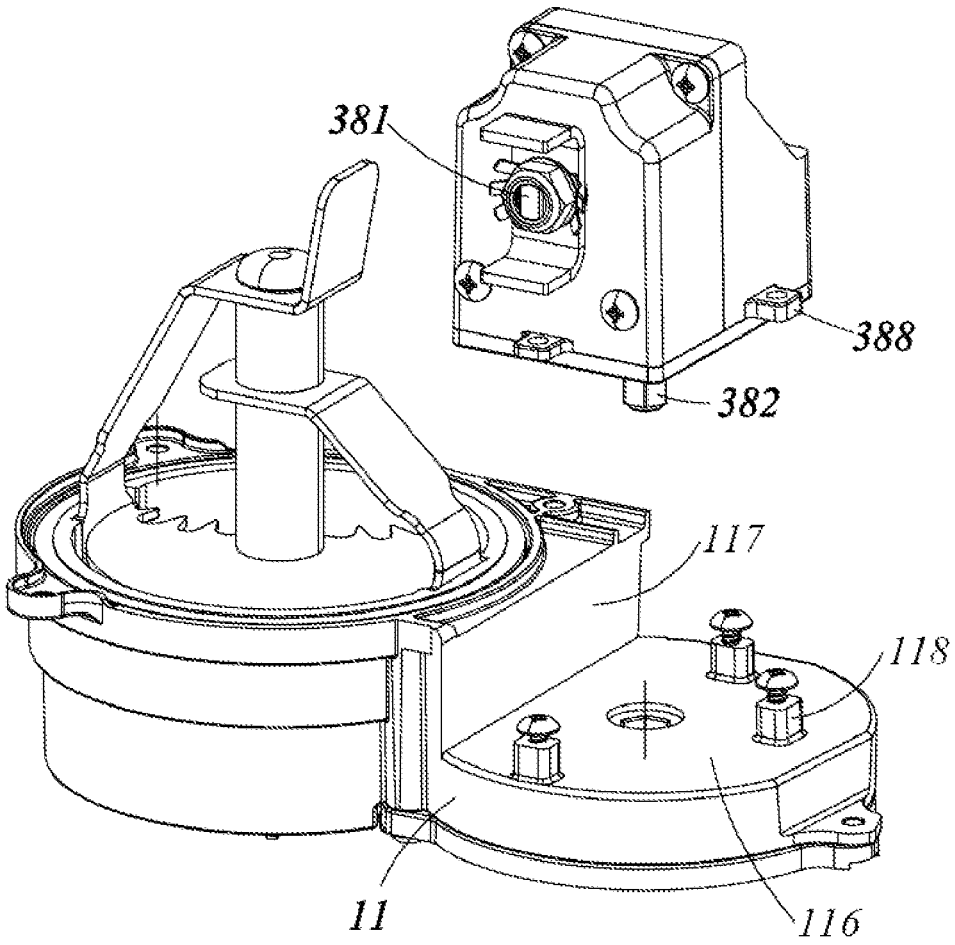
FIG. 10 is a perspective view of the ice crushing device of FIG. 9 with an independent gear box begins separated from a housing assembly.
Figure 11:
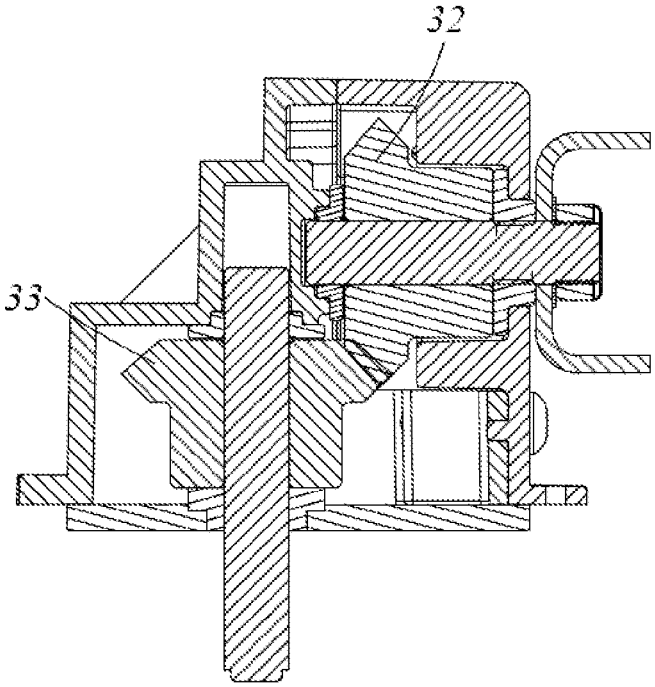
FIG. 11 is a cross-sectional view of the independent gear box of FIG. 10.

FIG. 9 through FIG. 11 show another preferred embodiment of the present invention. In this embodiment, the driver 30 comprises a motor (not shown), a gear assembly driven by the motor, and a gear box 38 accommodating the gear assembly. The gear box 38 has an input end 381 connected with the motor and an output end 382, wherein the gear box is mounted on the housing 11, and an axis of the output end 382 is disposed in parallel with a rotation axis of the ice bucket 12. In this way, the gear assembly is enclosed in the gear box 38 and then assembled with the housing 11. When the driver 30 is running, chips, lubricating oil, and other impurities generated by the engagement of the gear assembly are sealed in the gear box 38, and therefore cannot enter the housing and then enter the ice bucket 12 to pollute the ice cubes or crushed ice. The gear box 38 may be formed by connecting and fixing two half shells, and can be conveniently manufactured and assembled. Certainly, the driver 30 may further comprise a cylindrical gear driven by the gear assembly, and the cylindrical gear is installed in the housing 11 to mesh with the external teeth of the ice bucket to drive the ice tank to rotate. The gear assembly also preferably comprises a first bevel gear 32 connected to the motor and a second bevel gear 33 meshing with the first bevel gear 32. The cylindrical gear and the second bevel gear 33 are disposed coaxially and relatively fixedly. Certainly, the gear assembly may also be other types of gears.

Further, the housing 11 is provided with a horizontal mounting surface 116 perpendicular to the rotation axis of the ice bucket and a lateral mounting surface 117 perpendicular to the horizontal mounting surface 116. The horizontal mounting surface 116 is provided with three mounting posts 118. The gear box 38 comprises a bottom surface and four side surfaces perpendicular to the bottom surface, the bottom surface abuts against the horizontal mounting surface 116, one of the side surfaces abuts against the lateral mounting surface 117, the three mounting posts 118 correspond to the remaining three side surfaces respectively and the three side surfaces respectively protrude out of a mounting portion 388, and the mounting portion 388 is connected to the corresponding mounting post 118 through a fixing member. As such, the mounting and positioning of the gear box 38 is made more reliable and convenient.

Figure 12:
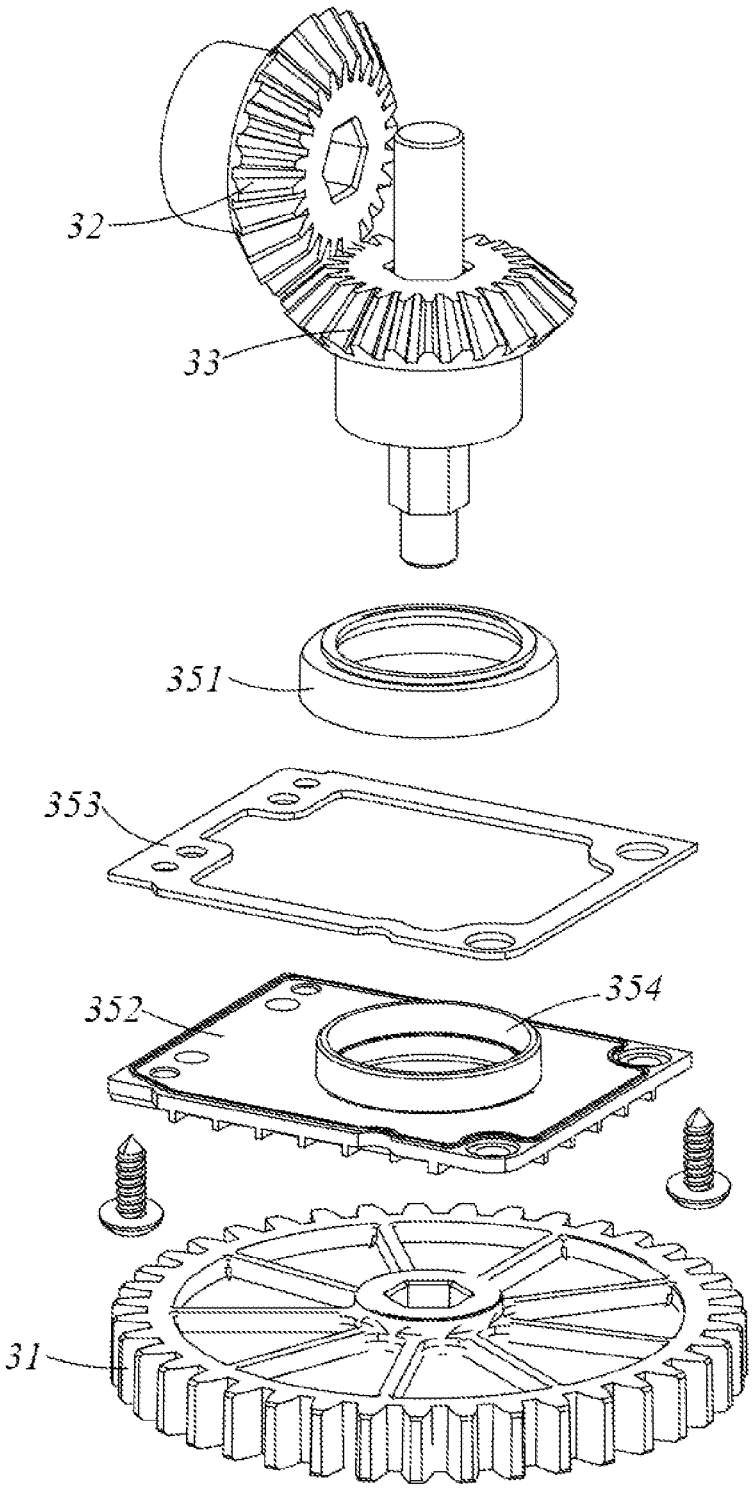
FIG. 12 is an exploded perspective view of a portion of a driver of an ice crushing device in a third preferred embodiment of the present invention.
Figure 13:
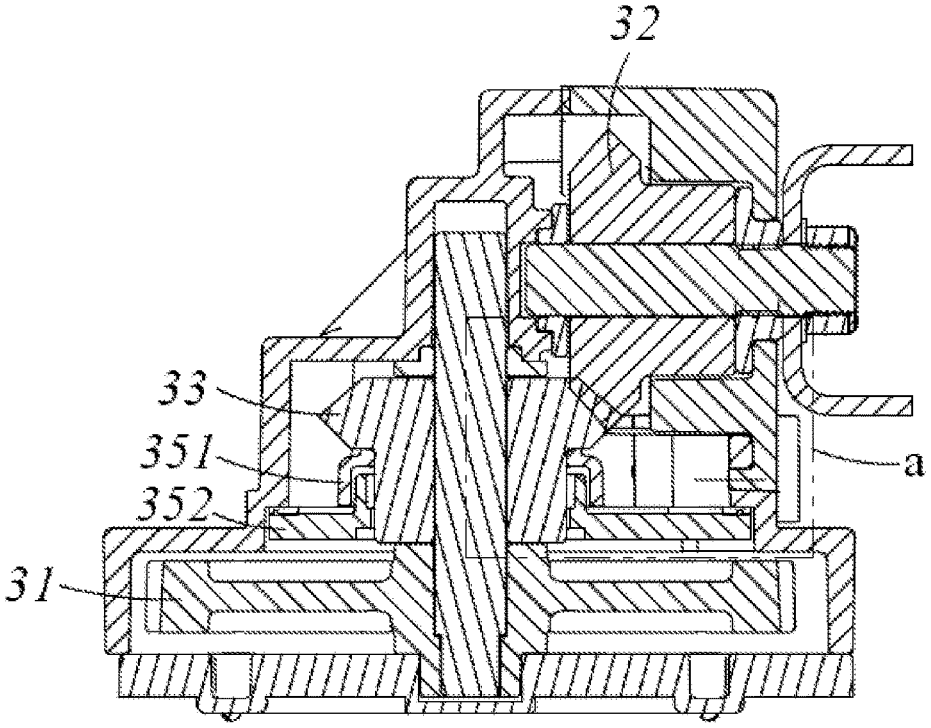
FIG. 13 is a cross-sectional view of the driver shown in FIG. 12.
Figure 14:
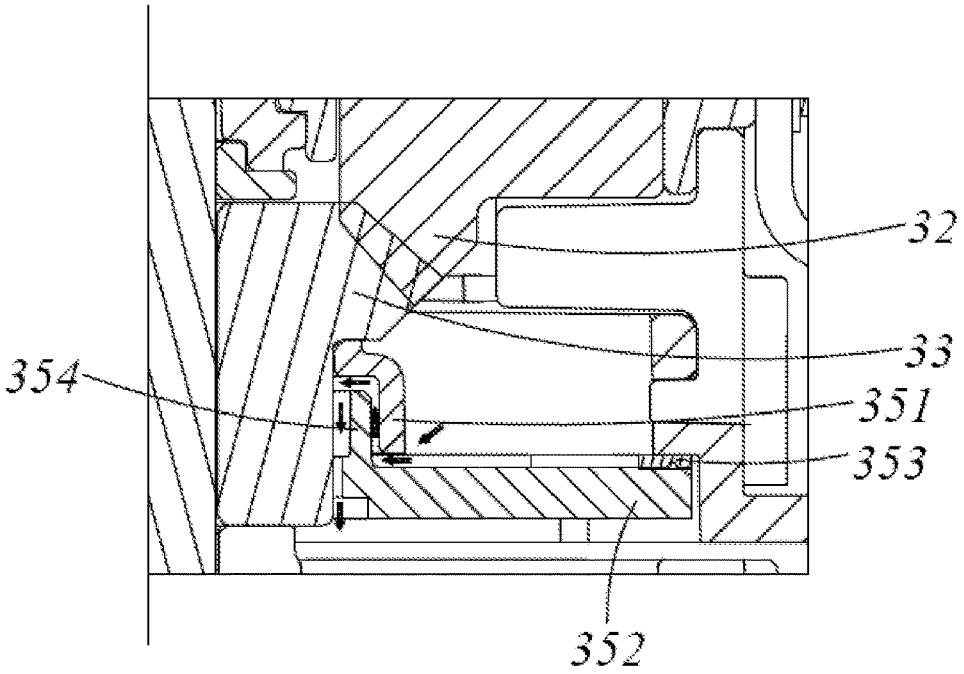
FIG. 14 is an enlarged schematic view of part a of FIG. 13.
Figure 15:
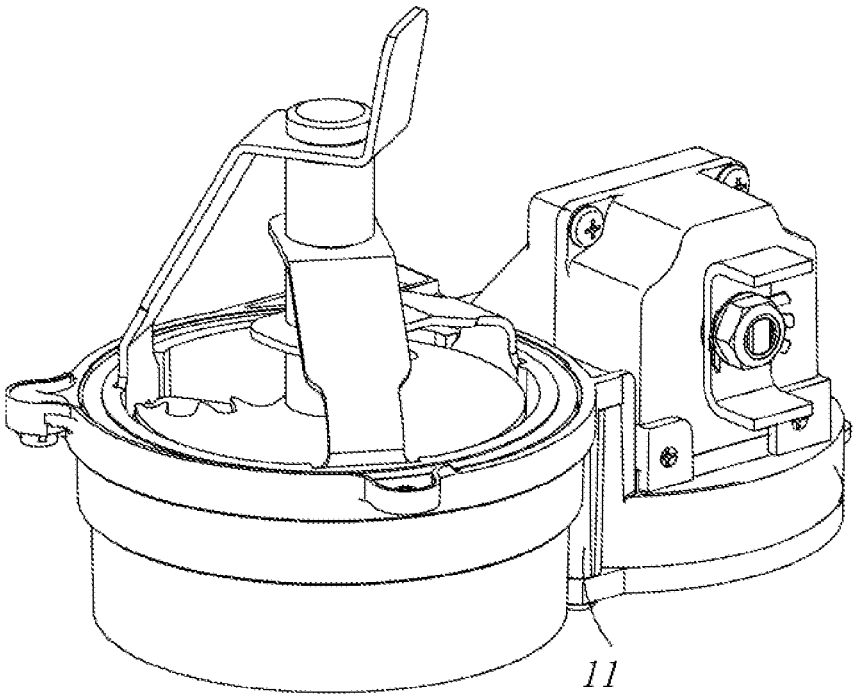
FIG. 15 is a perspective view of an ice crushing device in a fourth preferred embodiment of the present invention.
Figure 16:
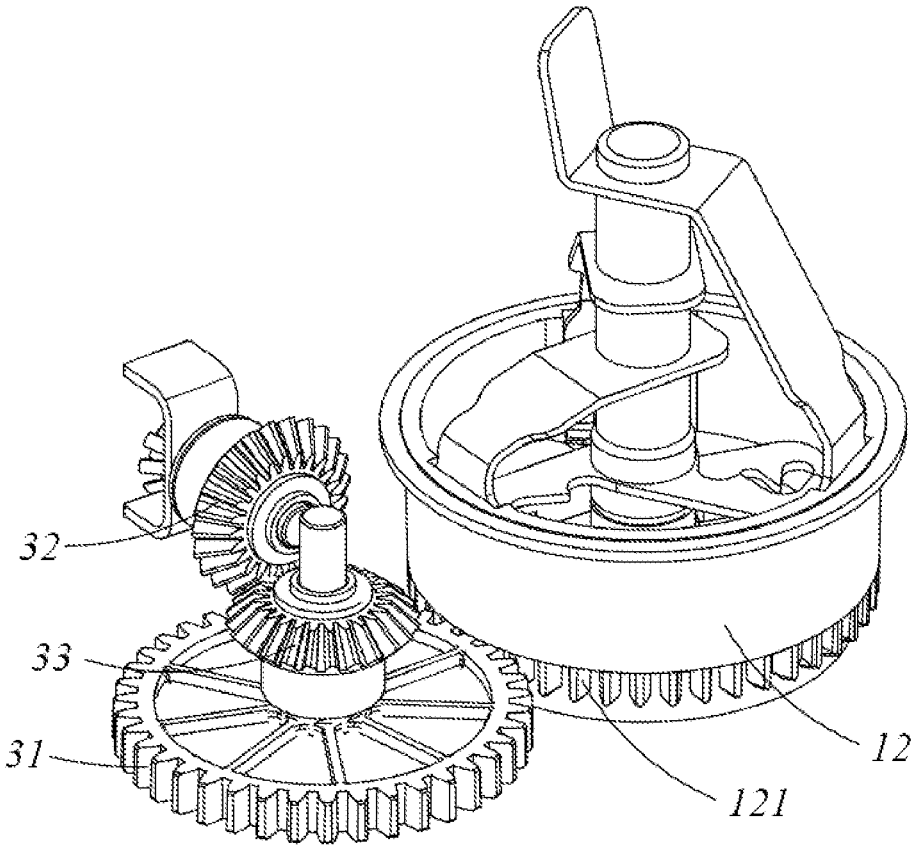
FIG. 16 is a perspective view of the ice crushing device of FIG. 15 with the housing being removed.
Figure 17:
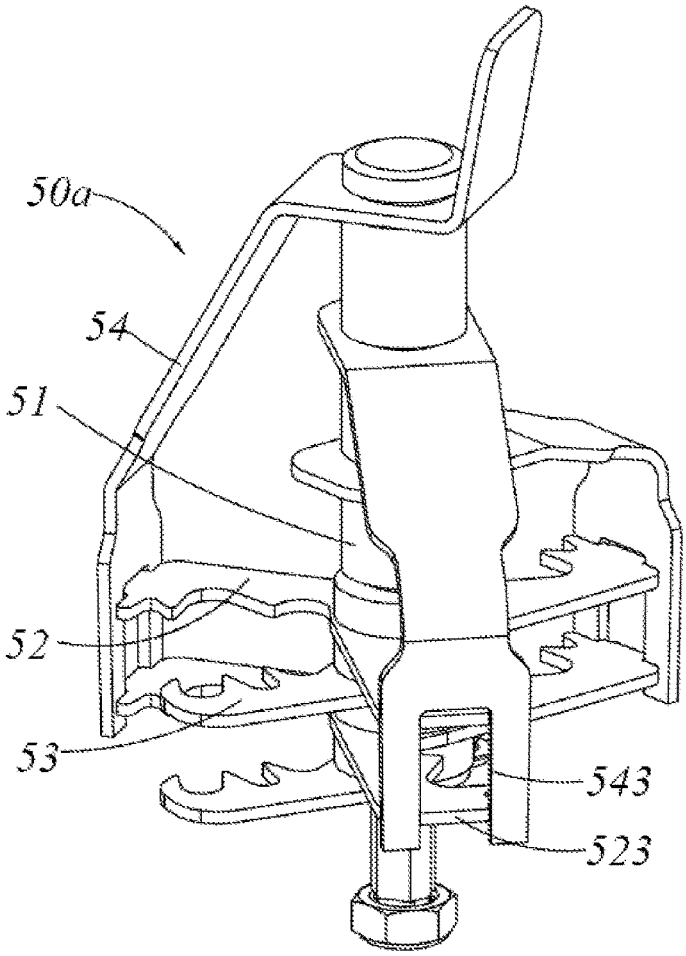
FIG. 17 is a perspective view of an ice crusher of the ice crushing device of FIG. 15.
Figure 18:
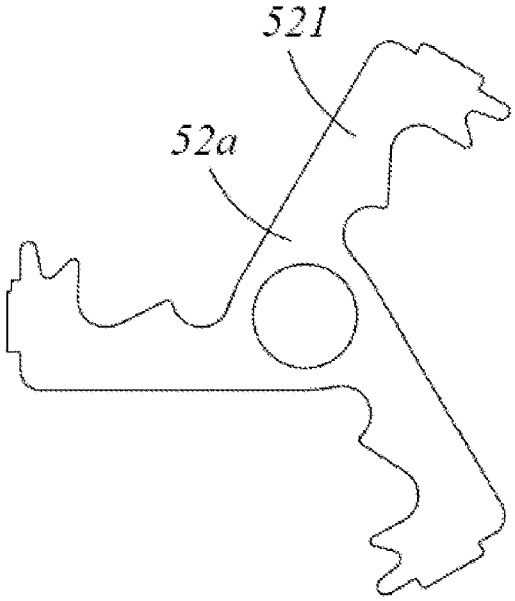
FIG. 18 is a plan view of a moveable ice cutter of the ice crusher of FIG. 17.

FIG. 12 through FIG. 14 show a further preferred embodiment of the present invention. In this embodiment, a stop ring 351 and a seal assembly that engage with each other are disposed between the second bevel gear 33 and the cylindrical gear 31. The seal assembly matches the housing to separate the space between the second bevel gear 33 and the cylindrical gear 31, that is, the seal assembly seals the space around the second bevel gear 33. The seal assembly comprises a raised ring 354 raised in the axial direction. One end of the stop ring 351 abuts against the bottom end surface of the second bevel gear 32, and the raised ring 354 extends into the inside of the stop ring 351 and overlaps the stop ring 351 along the projection in the radial direction. The stop ring 351 comprises a ring-shaped main body and a neck located at one end of the main body. The inner diameter of the neck is smaller than the inner diameter of the main body. The neck abuts against the second bevel gear 33. The stop ring 351 is interference fitted with the second bevel gear 33 through the neck. The seal assembly comprises a cover plate 352 and a seal gasket 353. The raised ring 354 is disposed on the cover plate 352, and the seal gasket 353 is disposed between the cover plate 352 and the housing 11. The seal gasket 353 is configured to be hollow and disposed along the periphery of the cover plate 352. Since the stop ring 351 and the seal assembly are provided, iron chips cannot experience a rising process as shown by the arrow in FIG. 14 and cannot fall off. Meanwhile, because the gap between the stop ring 351 and the cover plate 352 is very small, about 0.5 mm to 1 mm, iron chips substantially cannot enter the side of the ice bucket from the side of the driver 30.

FIG. 15 through FIG. 18 show a further preferred embodiment of the present invention. In this embodiment, the ice crusher 50*a* comprises an ice cutter shaft 51 fixed with respect to the housing, and several movable ice cutters 52*a* and several fixed ice cutters 53 disposed on the ice cutter shaft 51 at an interval. Each movable ice cutter 52*a* comprises three blades 521 evenly distributed in the circumferential direction. The ice crusher 50*a* further comprises three ice agitating rods 54 connected to the ice cutter shaft 51, the three ice agitating rods 54 are connected to at one end of the ice cutter shaft 51 away from the ice-discharging port, the three ice-agitating rods 54 are fixed corresponding one to one with the three blades and relative to the circumferential direction, and at least one of the blades 521 or one of the ice agitating rods 54 is fixed relative to circumferential direction of the ice bucket. Preferably, the inner wall of the ice bucket 12 is provided with three first limiting grooves 123 extending in the axial direction, one end of the three ice agitating rods 54 are respectively snap fitted in the corresponding first limiting grooves 123, and three blades 521 are circumferentially fixed to the corresponding three ice agitating rods 54. In addition, two movable ice cutters 52 and two fixed ice cutters 53 are provided. The movable ice cutters 52 and the fixed ice cutters 53 are disposed adjacent to each other. One end of each ice agitating rod is provided with a second limiting groove 543 extending in the axial direction. The corresponding blades of the two movable ice cutters are respectively provided with a projection 523, and the corresponding two projections of the corresponding two blades of the upper and lower movable ice cutters 52 are all snap fitted in the second limiting slot 543. With three ice agitating rods being provided, the ice agitation amount each time is small, the torque need for agitation is small, and sticking is impossible. Since the movable ice cutters each having three blades are provided, the ice crushing amount each time is reduced, the ice crushing is easier, and the mechanism will not be stuck due to too large ice crushing amount at a single time; meanwhile, the ice feeding amount is the same as the movable ice cutter having two blades, and reduction of the ice crushing rate will not be caused. The ice crushing is easier, and the ice crushing rate is improved to a certain degree.

It should be understood that although the description is described according to the embodiments, not every embodiment only comprises one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. An ice crushing device, comprising:

a housing assembly comprising a housing and an ice bucket supported in the housing;

a driver for driving the ice bucket to rotate;

an ice crusher disposed in the ice bucket;

wherein the housing assembly further comprises an ice-discharging plate provided at a bottom of the ice bucket, the ice-discharging plate is provided with an ice-discharging port communicated with the ice bucket, ice cubes prepared by an ice maker are discharged out of the ice-discharging port after being crushed in the ice bucket by the ice crusher, wherein the ice crusher comprises an ice cutter shaft fixed with respect to the housing, and several movable ice cutters and several fixed ice cutters disposed on the ice cutter shaft at an interval, each movable ice cutter comprises three blades evenly distributed in the circumferential direction, the ice crusher further comprises three ice agitating rods connected to the ice cutter shaft, the three ice agitating rods are connected to at one end of the ice cutter shaft away from the ice-discharging port, the three ice-agitating rods are fixed corresponding one to one with the three blades and relative to the circumferential direction, and at least one of the blades or one of the ice agitating rods is fixed relative to circumferential direction of the ice bucket;

wherein the driver comprises a motor and a cylindrical gear driven by the motor;

wherein the housing comprises a first portion that houses the ice bucket and a second portion in which the driver is mounted;

wherein the housing assembly further comprises a bottom plate, a bottom of the second portion is open, the bottom plate covers the bottom of the second portion to seal the cylindrical gear between the second portion and the bottom plate, the bottom of the ice-discharging plate is provided with a protrusion at a position corresponding to the groove, the bottom plate is provided with a recess, and the protrusion is snap fitted in the recess.

2. The ice crushing device according to claim 1, wherein the inner wall of the ice bucket is provided with at least one first limiting groove extending in the axial direction, one end of one of the three ice agitating rods is snap fitted in the first limiting groove, and one of the three blades is circumferentially fixed to the ice agitating rod.

3. The ice crushing device according to claim 2, wherein two movable ice cutters and two fixed ice cutters are provided, the movable ice cutters and the fixed ice cutters are disposed adjacent to each other, one end of each ice agitating rod is provided with a second limiting groove extending in the axial direction, the corresponding blades of the two movable ice cutters are respectively provided with a projection, and the corresponding two projections of the corresponding two blades of the upper and lower movable ice cutters are all snap fitted in the second limiting groove.

4. The ice crushing device according to claim 1, wherein an outer circumference of the ice bucket is provided with external teeth, and the cylindrical gear meshes with the external teeth to drive the ice bucket to rotate.

5. The ice crushing device according to claim 4, wherein a gear assembly is provided between the motor and the cylindrical gear, the gear assembly comprises a first bevel gear connected to the motor and a second bevel gear meshing with the first bevel gear, and the cylindrical gear and the second bevel gear are disposed coaxially and relatively fixed.

6. The ice crushing device according to claim 4, wherein the first portion is configured to match the outer circumference of the ice bucket, an opening is provided on the first portion, and a meshing portion of the cylindrical gear and the external teeth is located at the opening.

7. The ice crushing device according to claim 6, wherein a groove extending along the circumferential direction of the ice bucket is provided between the ice-discharging plate and the first portion, the groove is communicated with the ice-discharging port, and a lower edge of the ice bucket projects into the groove.

8. The ice crushing device according to claim 6, wherein the bottom of the ice-discharging plate is provided with a clamping slot, and a portion of the bottom plate is snap fitted in the clamping slot.

9. A refrigerator, wherein the refrigerator comprising a cabinet, a door for opening or closing the cabinet, and the ice crushing device according to claim 1, the ice crushing device being disposed at the cabinet or the door.

* * * * *